US005713726A

United States Patent [19]

Nakayoshi

[11] Patent Number: 5,713,726

[45] Date of Patent: Feb. 3, 1998

[54] PUMP APPARATUS

[75] Inventor: Hideki Nakayoshi, Aichi, Japan

[73] Assignee: Aisin Seiki Kabushiki Kaisha, Aichi, Japan

[21] Appl. No.: 689,034

[22] Filed: Jul. 30, 1996

[30] Foreign Application Priority Data

Jul. 31, 1995 [JP] Japan ..... 7-194788

[51] Int. Cl.[6] ..... F04B 49/00

[52] U.S. Cl. ..... 417/310; 417/440; 417/292; 418/161

[58] Field of Search ..... 417/440, 310, 417/292; 418/171, 166

[56] References Cited

U.S. PATENT DOCUMENTS

| | | | |
|---|---|---|---|
| 3,491,697 | 1/1970 | Petersen | 418/166 |
| 4,270,884 | 6/1981 | Lintonbon | 417/292 |
| 4,446,697 | 5/1984 | Goscenski, Jr. | 60/443 |
| 4,798,177 | 1/1989 | Oomura et al. | 123/41.12 |
| 4,913,102 | 4/1990 | Ohmura et al. | 417/292 |

FOREIGN PATENT DOCUMENTS 4-272188 9/1992 Japan .

*Primary Examiner*—Timothy Thorpe
*Assistant Examiner*—Peter G. Korytwyk
*Attorney, Agent, or Firm*—Hazel & Thomas

[57] ABSTRACT

A pump apparatus includes a pump having a suction port and a discharge port for discharging the fluid sucked from the suction port, a return passage connecting the discharge port with the suction port for returning a portion of the fluid discharged from the discharge port into the suction port, a return flow control valve disposed in the return passage for controlling an amount of the portion of the fluid returned to the suction port through the return passage and an expanded chamber formed in the return passage and located between the suction port and the return flow control valve. The expanded chamber has a sectional area larger than that of the return passage.

3 Claims, 4 Drawing Sheets

PUMP APPARATUS

BACKGROUND OF THE INVENTION

1. Field of the Invention

The present invention relates to a pump apparatus.

2. Description of the Prior Art

A conventional pump apparatus is disclosed in, for example, Japanese patent application laid open publication number 4-272488. This pump apparatus includes pumping means having a suction port communicating with a suction passage and a discharge port for discharging the fluid sucked from the suction port through the discharge port, a return passage for returning a part of the fluid discharged from the discharge port into the suction port and a return flow control valve for controlling an amount of the fluid which is returned to the suction port through the return passage. A downstream part of the return passage, which is located between the suction port and the return control valve, has a constant sectional area and the suction passage communicates with this downstream part of the return passage. In this pump apparatus, when a portion of high pressure discharged fluid is returned into the suction port through the return passage, the fluid is sucked from the suction passage into the return passage and is supplied to the suction port, together with the returned fluid.

In the above-mentioned prior art pump apparatus, the sectional area of the return passage is reduced by the return flow control valve and the high pressure fluid is spouted into the downstream part of the return passage at high speed. As a result, bubbles are generated in the fluid by the cavitation. Since the downstream part of the return passage has a constant sectional area and directly communicates with the suction port, the bubbles are sucked together with the fluid. Accordingly, the efficiency of the pump apparatus decreases and there is the danger of noise being generated.

SUMMARY OF THE INVENTION

It is, therefore, an object of the present invention to provide an improved pump apparatus which overcomes the above drawbacks.

It is another object of the present invention to provide an improved pump apparatus which can remove bubbles generated in the return passage.

In order to achieve these objectives, there is provided a pump apparatus which includes a pump having a suction port and a discharge port for discharging the fluid sucked from the suction port, a return passage connecting the discharge port with the suction port for returning a part of the fluid discharged from the discharge port into the suction port, a return flow control valve disposed in the return passage for controlling an amount of the fluid which is returned to the suction port through the return passage and an expanded chamber formed in the return passage which is located between the suction port and the return flow control valve. The expanded chamber has a sectional area which is larger than that of the return passage.

BRIEF DESCRIPTION OF THE DRAWINGS

Additional objects and advantages of the present invention will become more apparent from the following detailed description of a preferred embodiment thereof when considered with reference to the attached drawings in which.

DESCRIPTION OF THE PREFERRED EMBODIMENTS

A pump apparatus, in accordance with a preferred embodiment of the present invention will be described with reference to the attached drawings wherein like numerals represent like parts.

Figure 1:
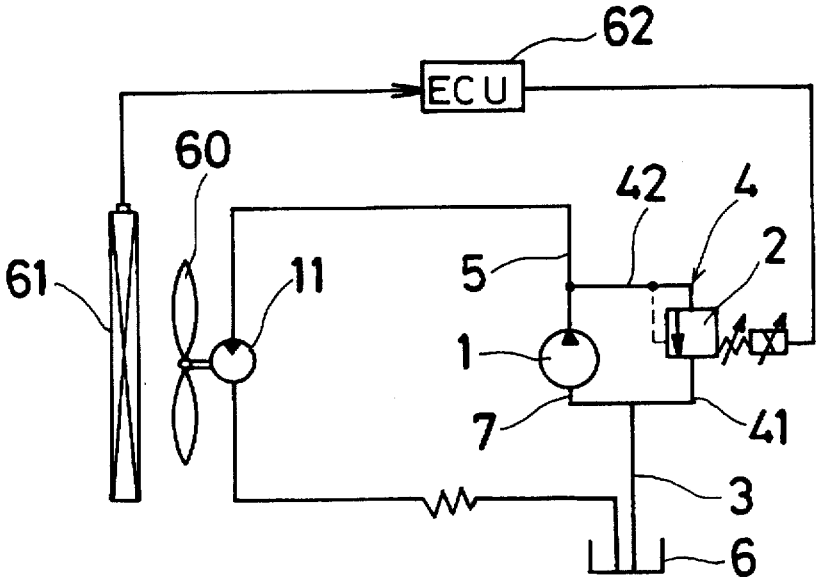
FIG. 1 shows a block diagram of a fan system to which a pump apparatus in accordance with the present invention is applied thereto.
Figure 2:
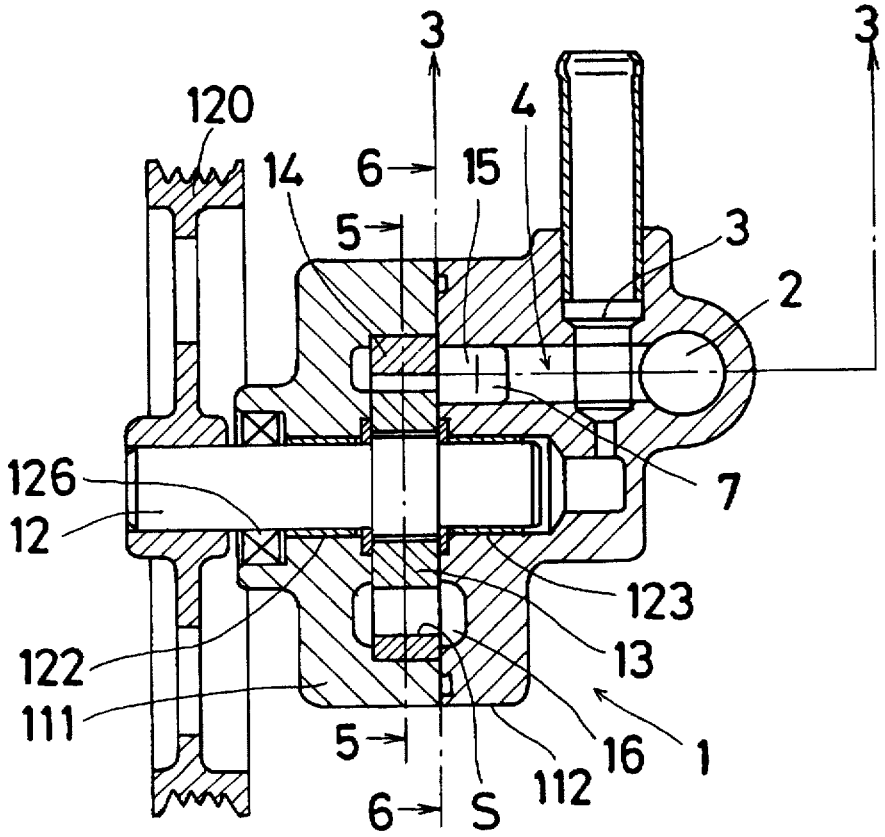
FIG. 2 shows a cross-sectional view of an embodiment of a pump apparatus in accordance with the present invention.
Figure 5:
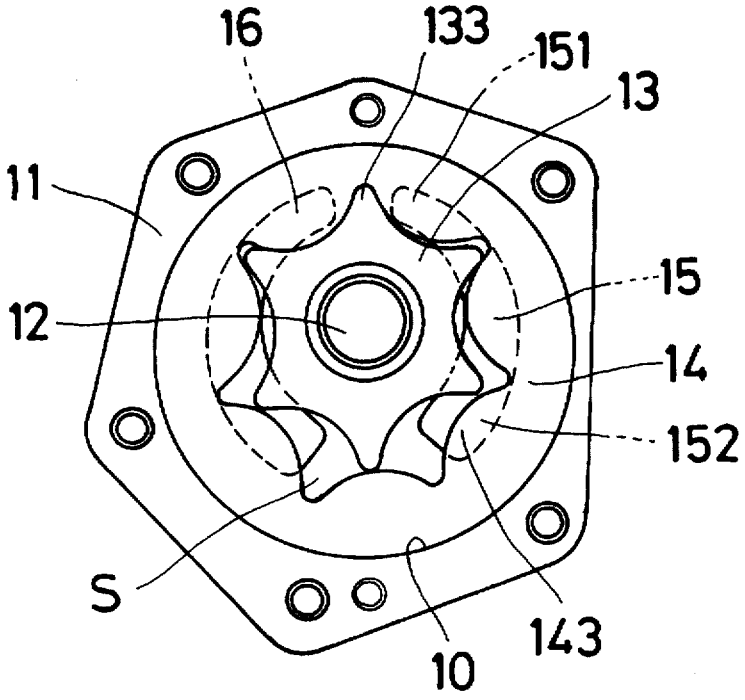
FIG. 5 illustrates a cross-sectional view taken along line 5—5 of FIG. 2.
Figure 6:
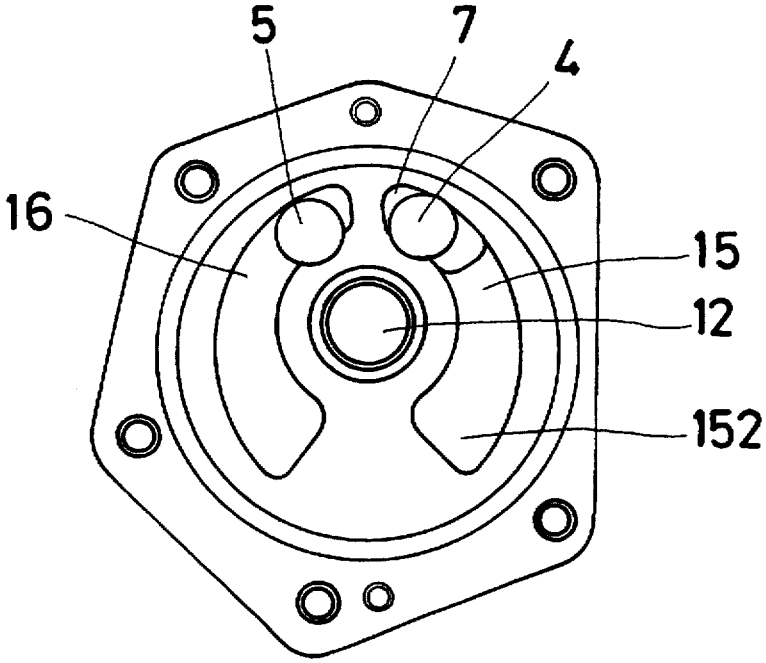
FIG. 6 illustrates a cross-sectional view taken along line 6—6 of FIG. 2.

Referring to FIG. 1, a pump apparatus comprises a pump 1, a return flow control valve 2, a suction passage 3, a return passage 4 and a discharging passage 5. Referring to FIGS. 2, 5 and 6, the pumping means 1 includes a housing 11 which is comprised of a front housing 111 having an inner bore 10 and a rear housing 112 which is fixed to the front housing 111 so as to close the inner bore 10. The pump 1 further includes an outer rotor 14 rotatably supported in the inner bore 10 and being provided an inner bore having seven internal projecting portions (teeth) 143 at regular intervals, an inner rotor 13 disposed in the inner bore of the outer rotor 14 so as to be able to rotate by a driving shaft 12 and having six external projecting portions (teeth) 133 at regular intervals which are engaged with the internal projection portions 133 so as to form six pump chambers S therebetween, respectively, a suction port 14 formed on the rear housing 112 and communicating with one group of pump chambers S and a discharge port 16 formed on the rear housing 112 and communicating to the other group of the pump chambers S. The suction port 15 and the discharge port 16 are symmetrically formed with respect to the driving shaft 12. Both side surfaces of the inner and outer rotors 13 and 14 are in slidable contact with the end faces of the front and rear housings 111 and 112.

The driving shaft 12 penetrates the inner rotor 13 and is fixed to the inner rotor 13. One end of the driving shaft 12 is rotatably supported on a bore of the rear housing 112 through a bearing 123. The other end of the driving shaft 12 penetrates a bore of the front housing 111 and is fixed to a pulley 120. A part of the driving shaft 12 between the pulley 120 and the inner rotor 13 is rotatably supported on the bore of the front housing 111 through a bearing 122. Numeral 126 is an oil seal that is disposed in an open end of the bore of the front housing 111. Now, an axial center of the driving shaft 12 (=an axial center of the inner rotor 13) and an axial center of the inner bore 10 of the front housing 111 (=an axial center of the inner bore of the outer rotor 14) are not coaxial. The distance of eccentricity is set to a predetermined distance.

The pulley 120 is connected to a pulley fixed to a crank-shaft of an engine (not shown) through a belt (not shown) and, therefore, is rotated by the engine. When the driving shaft is rotated through the pulley 120, the inner rotor 13 is rotated and the outer rotor 14 is slowly rotated by the inner rotor 13. When the inner and outer rotors 13 and 14 are rotated, the volume of each of the pump chambers S, which communicate with the suction port 15, is increased in response to the rotation, and the volume of each of the pump chambers S which communicate with the discharge port 16 is decreased in response to the rotation. As shown in FIGS. 5 and 6, the volume of the pump chamber S, which communicate with an upper part 151 of the suction port 15 is smaller than that of the pump chamber S which communicates with a lower part 152 of the suction port 15. Therefore, a diametrical size of the suction port 15 is successively increased from the upper part 151 to the lower part 152 in the circumferential direction so that the fluid is smoothly sucked from the suction port 15 into the pump chambers S. Simultaneously, the volume of the pump chamber S, which communicates with an upper part of the discharge port 16, is smaller than that of the pump chamber S which communicates with a lower part of the discharge port 16. Therefore, a diametrical size of the suction port 16 is successively decreased from the lower part to the upper part in the circumferential direction so that the fluid is smoothly discharged from the pump chambers S to the discharge port 16. In this embodiment, as shown in FIG. 1, the fluid which is discharged to the discharge port 16 is supplied to an inlet side of a hydraulic motor 11 through the discharging passage 5. The hydraulic motor 11 drives a fan 60 for cooling a radiator 61 of the cooling system of the engine. An outlet side of the hydraulic motor 11 communicates with a reservoir 6.

The return passage 4 is formed on the rear housing 112 so that a part of the fluid discharged from the discharge port 16 is returned to the suction port 15. The return flow control valve 2 is disposed in the return passage 4 and controls the amount of the fluid which is returned to the suction port 15 in response to a control signal from ECU 62 based on the temperature of the cooling water in the radiator 61. The return flow control valve 2 is disposed in the rear housing 112. The rear housing 112 has a cylindrical bore **112*a* which constitutes a part of the return passage 4 and into which one end of an upstream part 42 along with the discharging passage 5, and one end of a downstream part 41 open. Now, the other end of the upstream part 42 communicates with the discharge port 16 and the other end of the downstream part 41 communicates with the suction port 15, both by operation of the inner rotor 13 and outer rotor 14 forming the separate groups of pump chambers S that correspondingly interact with the discharge port 16 and suction port 15. In other words, by operation of the inner and outer rotors 13, 14, fluid flows into the upstream part 42 of the return passage 4 with a portion of the fluid diverted into discharging passage 5. As the fluid passes through the return flow control valve 2, the fluid flows through the downstream part 41 of the return passage 4 that interacts with the suction part 15. Fluid is provided into the upstream part 42 via the discharge part 16. A hollow sleeve 235 is housed in the cylindrical bore 112*a* and a fluid return passage 227 is formed between the outer surface of the sleeve 235 and the inner surface of the cylindrical bore 112*a*. The sleeve 235 has an outlet hole 235*a* opening the downstream part 41 and a spool 219 is slidably accommodated in the sleeve 235. The spool 219 is provided with a stepped bore having a first bore and a second bore and a wall portion is formed between the first and second bores. An orifice 220 communicating between the first and second bores is formed on the wall portion of the spool 219. The spool 219 is normally urged by a coil return spring 226 in one direction so that the left side of the spool 219 contacts with a ring which is fixed in the bore of the spool 219. Plunger means 222 is provided at the other side of the cylindrical bore 112*a*. The plunger means 222 includes a plunger 230 made of magnetic material and having a central bore, a pilot valve 228 press fitted into the central bore of the plunger 230 and having a central passage 229 therein, a first core 237 fixed on the sleeve 235 and having a central bore and a hole 237*a* which communicates between the fluid return passage 227 and the central bore, and a valve seat member 236 fixed to the first core 237 and having a central bore and a return hole 221 which is opened and closed by the pilot valve 228 urged by a spring 238. The first core 237 is made of magnetic material. The pilot valve 228 is housed slidably in the central bore of the valve seat member 236. The pilot valve 228 is provided with radial holes 228*a* which can communicate the central passage 229 with the return hole 117 and with radial holes 228*b* which communicate the central passage 229 with the central bore of the first core 237**.

In an interior space formed in the sleeve 235, a pressure chamber 217 is defined by the spool 219, the first core 237 and the valve seat member 236. The pressure chamber 217 communicates with the upstream part 42 through the orifice 220. An electromagnetic coil 223 is wound around a hollow bobbin made of resin and is connected to a terminal (not shown). The first core 237 is fitted into one end of an inner bore of the bobbin and a second core 234 having a bore is fitted into the other end of the inner bore of the bobbin. A cylindrical yoke member 239 which has a bore and whose one end is connected to the first core 237 is fitted on the outer circumferential portion of the coil 223 and the other end of the yoke member 239 is fixed to the second core 234. An adjusting screw member 240 is screwed into the bore of the second core 234 and is engaged with one end of the spring 238 which urges the pilot valve 228 so as to close the return hole 221. Now, the return flow control valve 2 can be constituted by a mechanical valve which controls the fluid communication of the return passage 4 in response to the discharge pressure of the pumping means.

When the electric current is not supplied to the electromagnetic coil 223, the pilot valve 228 closes the return hole 221. Therefore, since the pressure difference between the upstream part 42 and the pressure chamber 217 is not generated, the spool 219 is in the position at which the fluid communication between the upstream part 42 and the downstream part 41 through the outlet hole **235*a* is not allowed. Accordingly, in this condition, all of the fluid which is discharged from the discharge port 16 is supplied to the discharging passage 5. When the electric current is supplied to the electromagnetic coil 223, the electromagnetic circuit is formed about the electromagnetic coil 223 by the first core 237, the plunger 230, the second core 234 and the yoke member 239. The electromagnetic force is produced to displace the pilot valve 228 toward the second core 234. When a sum of the electromagnetic force and the magnitude of the oil pressure in the pressure chamber 217 is less than the urging force of the spring 238, the return hole 221 is closed by the pilot valve 228. When the sum of the pressure in the pressure chamber 217 and the electromagnetic force becomes higher than the urging force of the spring 238, the pilot valve 228 is displaced rightward (in FIG. 3) to open the return hole 221 through the central passage 229. A pressure difference is produced between the upstream part 42 and the pressure chamber 217 for the reason that a fluid flow from the upstream part 42 into the pressure chamber 217 through the orifice 220 is less than a fluid flow from the pressure chamber 217 to the fluid return passage 227. The pressure difference between the upstream part 42 and the pressure chamber 217 causes the spool 219 to move rightward (in FIG. 3) so that the upstream part 42 directly communicates with the downstream part 41 through the outlet hole 235***a*. Thereby, the fluid is spouted from the upstream part 42 into the downstream part 41. As the result of the direct fluid communication between the upstream part 42 and the downstream part 41, the pressure in the upstream part 42 is reduced and this pressure difference is diminished. When the pressure in the pressure chamber 217 is decreased, the pilot valve 228 is displaced leftward (in FIG. 3) by the urging force of the spring 238 to close the return hole 221 and the spool 219 is moved leftward (in FIG. 3) by the pressure in the pressure chamber 217 and the return spring 226 to cut off the direct fluid communication between the upstream part 42 and the downstream part 41. Thus, the pressure of the working fluid discharged from the discharge port 16 is linearly controlled in response to the variation of the temperature of water in the radiator 61.

Figure 3:
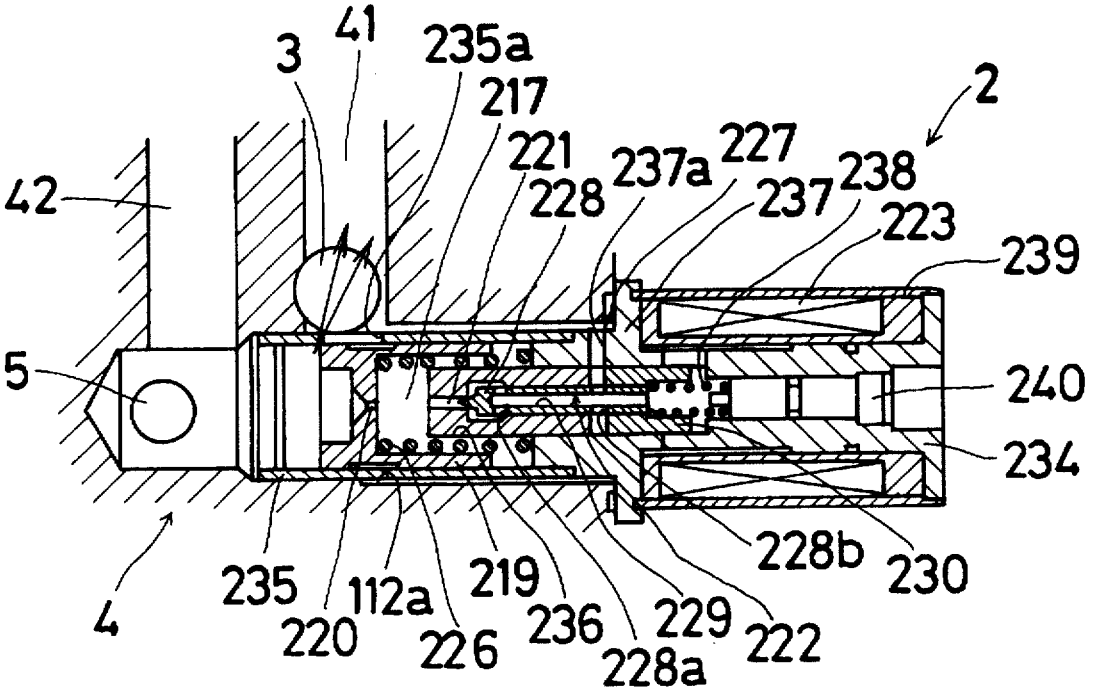
FIG. 3 shows a cross-sectional view taken along line 3—3 of FIG. 2.
Figure 4:
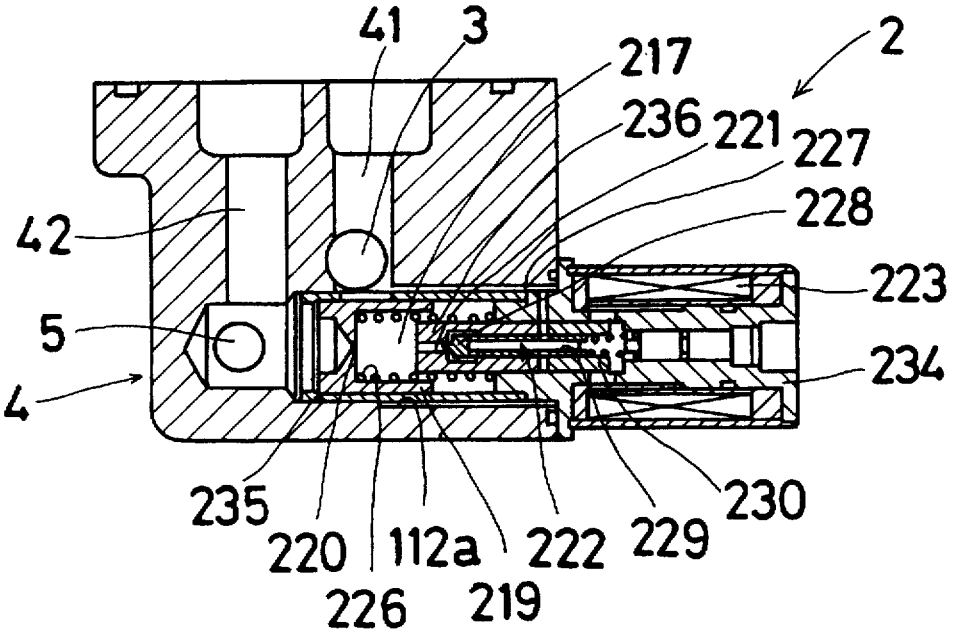
FIG. 4 is a partly expanded view of FIG. 3.

As shown in FIGS. 3 and 4, the other end of a suction passage 3, whose one end communicates with the reservoir 6, is opened into the downstream part 41. In this embodiment, the other end of the suction passage 3 is formed so that the axial center of the other end of the suction passage 3 does not intersect the axial center of the downstream part 41 of the return passage 4 and so that the axial center of the other end of the suction passage 3 intersects the direction of the spout when the fluid communication between the upstream part 42 and the downstream part 41 is opened by the return flow control valve 2.

Figure 7:
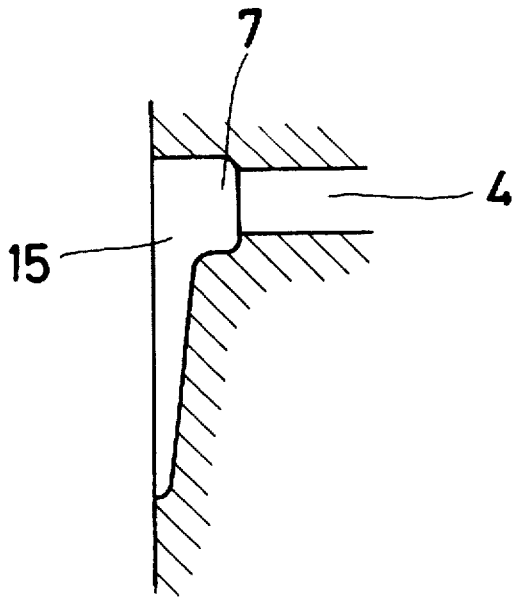
FIG. 7 shows an enlarged cross-sectional view of an expanded chamber of an embodiment of a pump apparatus in accordance with the present invention.

Furthermore, as shown in FIG. 7, expanded chamber 7, having a sectional area which is larger than that of the downstream part 41, is formed in the downstream part 41. One end of the expanded chamber 7 is connected to a most downstream portion of the downstream part 41 and the other end of the expanded chamber 7 is successively opened into the suction port 15.

The above-described pump apparatus operates as follows. When the driving shaft 12 is rotated and therefore the inner and outer rotors 13 and 14 are rotated, the fluid is sucked from the reservoir 6 into the pump chambers S through the suction passage 3 and the suction port 15 and is discharged from the pump chamber S into the discharging passage 5 through the discharge port 16. Thereby, the fluid is discharged from the discharge port 16 to the discharging passage 5 in response to the rotational speed of the driving shaft 12.

When the electric current is supplied to the electromagnetic coil 223 in response to the control signal from the ECU 62, the upstream part 42 communicates with the downstream part 41 as mentioned above. Thereby, the high pressure fluid is spouted into the downstream part 41 at high speed. In this embodiment, since the axial center of the other end of the suction passage 3 intersects the direction of the spout so that the opening end of the other end of the suction passage 3 is located at a portion in which the largest negative pressure is generated by the spout, the fluid is effectively sucked from the reservoir 6 into the downstream part 41 through the suction passage 3 by a supercharging effect and the fluid pressure in the downstream part 41 between the expanded chamber 7 and the suction passage 5 is increased. As a consequence, cavitation is prevented. Even if cavitation does occur and bubbles are generated in the fluid, the bubbles will disappear when the fluid, including the bubbles, passes into the expanded chamber 7. Specifically, since the expanded chamber 7 has a sectional area which is larger than that of the downstream part 41, the speed of running fluid is decreased and the fluid pressure is increased. Thereby, the bubbles in the fluid will disappear. Accordingly, since the fluid, including the bubbles, is not sucked into the pump chamber S, the efficiency of the pump apparatus does not decrease and the noise is not generated.

As mentioned above, a part of the fluid discharged from the discharge port is spouted into the return passage and bubbles are generated in the fluid. According to the present invention, since the expanded chamber whose sectional area is larger than that of the return passage is formed in the return passage between the suction port and the return flow control valve, when the fluid, including bubbles, which is generated by the spout passing in the expanded chamber, the flow rate of the fluid decreases and the pressure of the fluid increases. Thereby, the bubbles will disappear. Accordingly, the efficiency of the pump apparatus is prevented from decreasing and the noise is not generated.

The principles, preferred embodiments and modes of operation of the present invention have been described in the foregoing description. The invention, which is intended to be protected herein, should not, however, be construed as limited to the particular forms disclosed as these are to be regarded as illustrative rather than restrictive. Variations and changes may be made by those skilled in the art without departing from the spirit of the present invention. Accordingly, the foregoing derailed description should be considered exemplary in nature and not limited to the scope and spirit of the invention as set forth in the appended claims.

What is claimed is:

1. A pump apparatus comprising:

a pump including a housing that has an inner bore, an outer rotor rotatably disposed in the inner bore, said outer rotor having an inner rotor bore with a plurality of inner teeth, and an inner rotor located in the inner rotor bore and operatively connected to a driving shaft so as rotate therewith, the inner rotor having a plurality of outer teeth inter-engaged with the inner teeth of the outer rotor to form pumping chambers therebetween, said housing further having a suction port communicatively connected to a first group of the pumping chambers and a discharge port for discharging fluid sucked in from the suction port, the discharge port being communicatively connected to a second group of the pumping chambers;

a return passage defined in the housing and connecting the discharge port with the suction port for returning a portion of the fluid discharged from the discharge port into the suction port;

a return flow control valve disposed in the return passage for controlling an amount of the portion of the fluid returned to the suction port through the return passage; and an expanded chamber defined in the return passage and located between the suction port and the return flow control valve so as to extend in an axial direction of the drive shaft, the expanded chamber having a sectional area larger than that of the return passage.

2. The pump apparatus as claimed in claim 1, wherein a first end of the expanded chamber is communicatively connected to the return passage and a second end of the expanded chamber communicatively opens into the suction port.

3. The pump apparatus as claimed in claim 2, wherein a suction passage communicatively opens into the return passage and is located between the suction port and the return flow control valve so that an axial center of the suction passage intersects a direction of the fluid flowing into the return passage when the return flow control valve is opened.

* * * * *